United States Patent [19]

Stokes

[11] Patent Number: 5,005,709

[45] Date of Patent: Apr. 9, 1991

[54] PAPER RACK

[76] Inventor: Rick W. Stokes, 601 Glenway St., Madison, Wis. 53711

[21] Appl. No.: 371,940

[22] Filed: Jun. 27, 1989

[51] Int. Cl.[5] ..... A47F 7/00

[52] U.S. Cl. ..... 211/50; 100/34

[58] Field of Search ..... 211/50, 73; 248/174, 248/459; 100/34; D6/4

[56] References Cited

U.S. PATENT DOCUMENTS

| | | | |
|---|---|---|---|
| 2,321,802 | 6/1943 | Deubener | 100/34 |
| 3,038,403 | 6/1962 | Orelind | 100/34 |
| 3,903,789 | 9/1975 | Hurley | 100/34 |
| 4,061,084 | 12/1977 | Bakkeren | 211/50 X |
| 4,150,612 | 4/1979 | Kessler | 100/34 X |

*Primary Examiner*—Sarah A. Lechok

*Attorney, Agent, or Firm*—Andrus, Sceales, Starke & Sawall

[57] ABSTRACT

A newspaper bundling rack is formed from a cardboard blank. The rack includes four sidewalls connected by hinge creases for folding into rectangles. Bottom walls on each sidewall fold to form a bottom wall. Individual ledge members fold inwardly from the top edge of each sidewall with slot extended outwardly from the sidewall. Each ledge member includes a center ledge connected by folding creases to a connecting leg at the top edge of the sidewall and an inner supporting leg. Each ledge member is folded inwardly with the connecting ledge abutting the sidewall and the support leg depending downwardly and engaging the bottom wall. The ledges of adjacent ledge members overlap to form a strong support for the newspapers. The sidewalls and ledge members include interlocking mechanical slot and tabs for interconnecting of the several members in position.

13 Claims, 2 Drawing Sheets

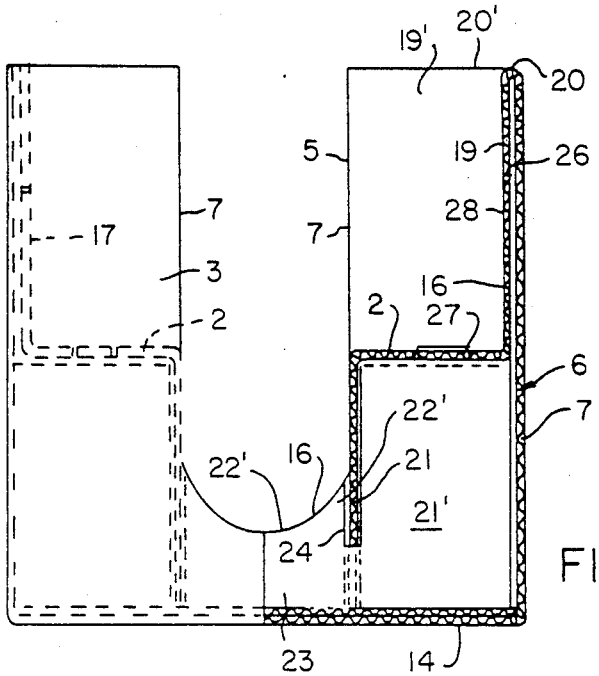
FIG. 4
FIG. 5
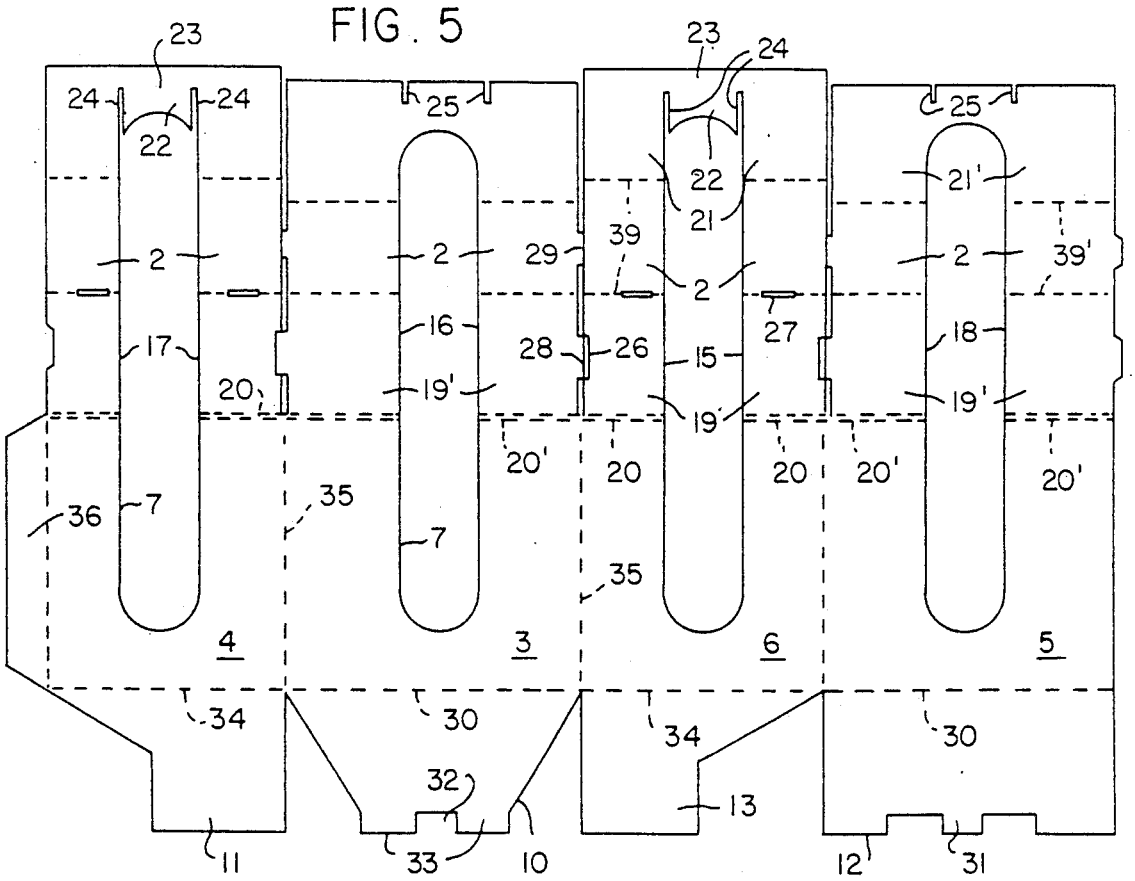

PAPER RACK

BACKGROUND OF THE PRESENT INVENTION

This invention relates to a paper rack and particularly to a paper rack for storage and bundling of newspapers, magazines and like articles.

The current production of paper products which are accumulated and constitute a waste product has grown significantly. The disposal of such paper products has also created severe environmental problems resulting in significant attempts at recycling. Newspapers constitute a typical and significant volume of such products. The recycling of newspapers and other similar paper products has created a significant recycled paper industry. Purchasers of newspapers are encouraged to accumulate the newspapers for recycling, and various recycling centers are available which will purchase accumulated newspapers, and various social organizations run periodic paper drive collections. Recent municipal ordinances have required bundling of papers for pick-up. However, the accumulation and bundling of newspapers or like product presents a significant difficulty in the handling of the waste paper by the accumulator and the recycling industry.

Various devices have been provided within which newspapers or like products can be accumulated in reasonably neat stacks and bundled through simple tying mechanisms to provide convenient handling of stacks of the newspapers. Open box-like structures having an intermediate shelf or ledge structure, for example, are shown in the following issued U.S. Pat. Nos. 230,802 which issued Mar. 19, 1974 and 249,617 which issued Sept. 26, 1978. In addition, wood rack units are commercially available. Holst, Inc. of Tawas City, Mich. has advertised a wood rack device in a recent publication of The Saturday Evening Post and The Chef's Catalog of Denver, Colo.

Although such devices are available, they are relatively costly. Even though formed of wood or metal to provide a relatively permanent unit, such units are usually stored in garages, outdoors or the like and have a finite life requiring periodic replacement.

Although the prior art devices provide a proposed solution, the devices are not as widely received and used as necessary to fully promote and encourage the accumulation and recycling of newspapers and the like. The commercially available devices do not provide ease in secure tying of the bundle. Thus, some provide for tying in a single direction and other require pre-stringing of the bundle chamber before placing of the paper in the device.

There therefore remains a need for a simple, reliable and particularly low cost unit or device permitting convenient bundling and securement of a reasonable stack of newspapers or like product for manual handling.

SUMMARY OF THE PRESENT INVENTION

The present invention is particularly directed to a low cost, open top storage rack device formed from a foldable board-like material such as paperboard, cardboard, plastic or like material. In accordance with the present invention, the rack or storage device includes an outer housing structure including a plurality of vertical sidewalls each of which is provided with an appropriate vertical slot located generally intermediate each side, and preferably centrally thereof. An internal foldable board unit defines intermediate vertical ledge supports within the housing and supported by vertical leg elements coupled to the housing to form an integrated assembly. The ledges are located in the four corners of the housing to the opposite sides of each sidewall slot and the slots provide access below the bundle. A string or other securement element is hooked about the bundle, preferably in two directions, to secure the stack together.

More particularly in a preferred construction, the housing and ledge board unit are formed from a single board member. The four sides are formed in side-by-side relation from within a single board member, with each of the sides provided with an appropriate slot projecting in spaced relation from a base or bottom end of the sidewall to the top of the sidewall. Bottom wall members are preferably formed within the single board member and secured to the sidewall by a hinge connection, and adapted to be folded inwardly to form a bottom wall. Ledge members are formed to the upper edge of each sidewall as separate outwardly extending flap members. Each of the ledge members includes a slot extension from the sidewall slot. The ledge members are connected to the sidewalls by a hinge connection and are adapted to be folded inwardly into overlying abutting relation to the sidewall. An intermediate portion of each ledge member includes a pair of fold or hinge connection lines defining a ledge portion and an outer leg portion. The leg portion and the connection portion in combination essentially corresponds to the depth of the sidewall. The ledge member is thus folded inwardly with the intermediate portion folded to extend normal to the connection leg portion and the leg portion, such that it is supported within the housing with the intermediate portion defining the ledge. The inner support legs of the ledge members are coupled to stabilize the ledge assembly within the housing, such as by interlocking elements. The adjacent legs may include vertical slots to overlap with and interengage with complementing portions of the adjacent ledge members. The various housing sidewalls and edges of the ledge members as well as the supporting leg structures can be provided with various notch and projection couplings to further stabilize the assembled rack from the board member. The total unit can conveniently be formed from a simple suitable cardboard, paperboard, plastic, metal or wood products or other material but has been particularly constructed out of die cut cardboard. The single board member can be folded into a flat compact unit to be stored, shipped and sold for convenience and low cost handling. The unit is readily assembled without any particular skill other than the ability to read and follow simple instructions.

Although preferably and conveniently formed from a single sheet or board member, the system is also uniquely adapted to a two piece construction wherein an outer housing including the sidewall and bottom are formed from a first sheet or board and an internal supporting ledge wall is formed from a separate board member. In this embodiment, the sidewall structure would be formed with the appropriate sidewall slots of an appropriate material to provide a firm, rigid outer housing. The inner platform or ledge unit would be formed from a flat board member with means for simple intercoupling on site within the housing and with a supporting leg structure to support the ledge portions. The ledge unit would include appropriate aligned vertical openings or slots forming a continuous extension of the housing sidewall slots. A very simple platform structure is formed from a single member having the similar flap construction and parallel similar legs to the opposite side of the intermediate platform portion which are similarly folded inwardly to define supporting legs within the housing.

Thus, within the teaching of the present invention, the rack structure for newspapers and other similar sheet-like products would include an integral housing member in combination with a single piece integral platform or ledge member and preferably with such two members formed as a single integral member.

The inventor has found that the invention provides a highly effective, reliable and low cost rack assembly which can be conveniently and readily marketed.

BRIEF DESCRIPTION OF DRAWINGS

The drawings furnished herewith illustrate the best modes presently contemplated for the invention and are described hereinafter.

In the drawings:

FIG. 4 is a vertical section taken generally on line 4—4 of FIG. 2;

FIG. 5 is a plan view of the single integrated blank from which the unit shown in FIGS. 1–4 is made.

DESCRIPTION OF THE ILLUSTRATED EMBODIMENT

Figure 1:
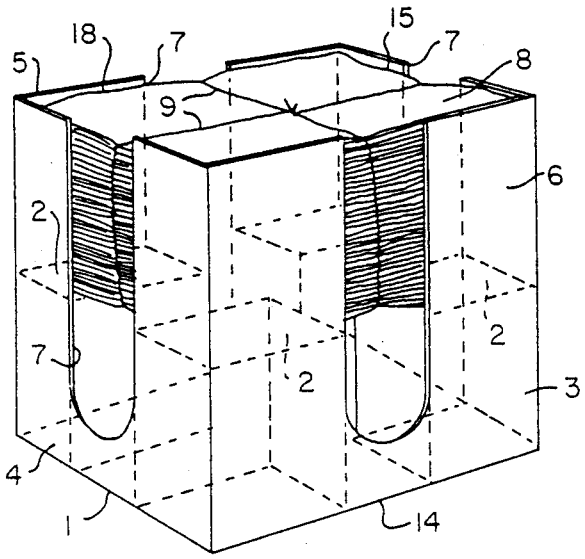
FIG. 1 is a pictorial view of a newspaper storage rack unit constructed in accordance with the present invention.
Figure 2:
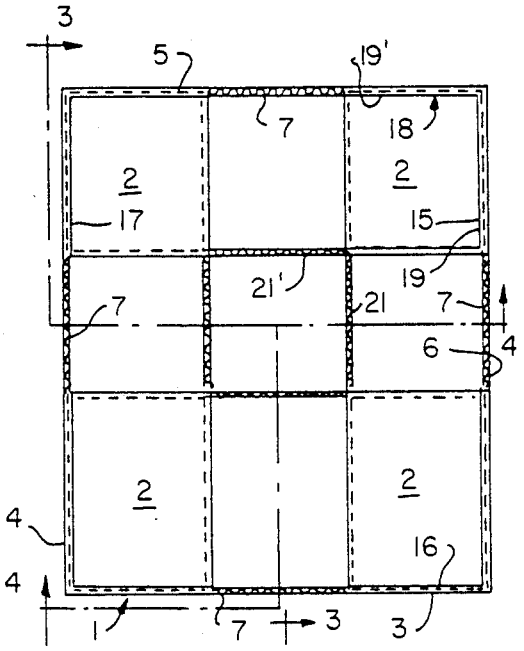
FIG. 2 is a plan view of FIG. 1.
Figure 3:
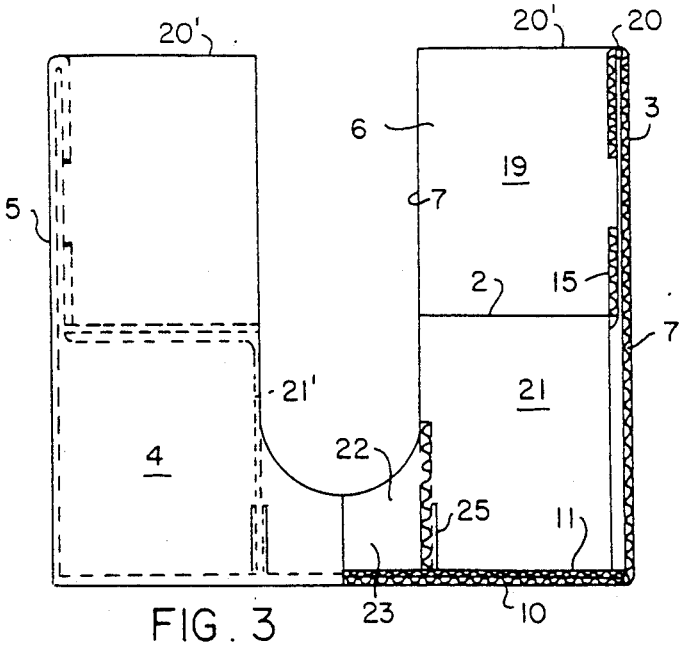
FIG. 3 is a vertical section taken generally on line 3—3 of FIG. 2.
Figure 6:
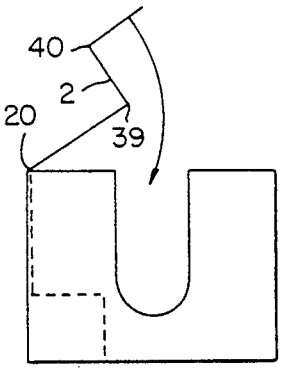
FIG. 6 is a diagrammatic view illustrating a folding step.

Referring to the drawings and particularly to FIGS. 1–4, a newspaper storage rack is illustrated including an outer rectangular open top housing 1 and four elevated spaced shelves or ledges 2 located in the four corners of the open top housing. The four vertical walls 3–6 inclusive of the housing 1, in alignment with the spacing between the ledges 2, include vertical slots 7 extending downwardly from the uppermost edge of the housing and with the bottom edge of each slot 7 beneath the ledges 2 but above the bottom of the housing 1. Papers 8 are accumulated as a stack within the rack resting on the ledges 2. When the housing 1 is filled to any desired level, the sidewall openings below ledges 2 as defined by the lower or bottom portions of slots 7 beneath the ledges permit the wrapping of a string 9, or any other suitable binding element, beneath and about the stack of papers 8 on two perpendicular axii for securely interconnecting of the papers into a separate bundle, as shown. The bundle of newspapers 8 is lifted from the housing to permit subsequent accumulation of newspapers 8. The space below the ledges 2 also provide for storage of accessories such as a knife or scissors, string and the like.

The present invention is particularly directed to the formation of the box or rack 1 from a foldable board material, such as cardboard, paperboard, plasticboard, metal and the like, and is illustrated as formed from conventional, readily available cardboard.

The rack is symmetrical about the aligned slots 7 in the opposite walls. With reference to FIGS. 1–4, inclusive, the front and back sidewalls 3 and 5 are identically formed while the left and right sidewalls 4 and 6 are similarly identically formed.

Each wall 3–6 of the housing 1 is integrally formed with a bottom flap 10–13. The four flaps 10–13 are connected by a hinge portions, and are folded and arranged in interlocked and overlapping relationship to form a closed bottom wall 14. The bottom wall 14 is desirable to provide a stabilized support for the boxlike structure and to further strengthen the structure against twisting and lateral movement The shelves or ledges 2 are formed as a part of integral extended members or flaps 15–18, one each secured to the upper edge of each sidewall 3–6. Each flap 15–18 is generally similarly formed. Referring to member 15 as shown in FIGS. 1–5, a first connecting leg portion 19 is secured by a hinge portion to the upper edge of the corresponding sidewall 6 and projects downwardly in abutting relation against the corresponding sidewall of the housing. The ledge 2 is integrally formed in the flap 15 and extends perpendicular from the lower edge of the depending connecting leg 19, and extends horizontally outwardly a distance slightly less than the distance to the edge of the slot 7 in the immediately adjacent sidewall. The outer edge of the ledge 2 connects to a further depending support leg 20 which projects downwardly into resting and supporting engagement with the bottom wall 14 formed by the overlapping bottom wall flaps 10–13. The ledge flap 15 include a slot 22 as a continuous extension of the sidewall slot 7 and is extended throughout the first connecting leg 19, the ledge 2 and support leg 21 to locate the edge of slot 22 in the leg portion 21 below the level of the stack of papers and shown generally aligned with the edge of slot 7. The slots 22 thus provide a clear entrance from each sidewall, above and below the ledge 2 for receipt of the bundle tie element 9. The bottom or outermost portion of ledge flap 15 is a continuous cross member beneath the slot 22, as at 23, integrally formed with a corresponding second connecting leg, shelf or ledge 2 on the same sidewall flap 15 and the support leg 21 connected to form member 23 as a continuous extended portion throughout the housing immediately beneath the internal slot 7 and 22. Cross member 23 is formed with vertical slits 24 which interlock with oppositely located slits 25 in the corresponding inner leg element of the adjacent ledge member formed to the adjacent sidewalls 3 and 5 of the housing 1. The sidewall 4 is identically formed and corresponding elements are similarly numbered.

Each of the sidewalls 3 and 5 are also similarly formed to interlock with the corresponding elements of sidewalls 4 and 6. The corresponding member or elements are identified by corresponding prime numbers. The internal shelf or ledge member 16 and 18, similar to the members 15 and 17 include the connecting legs 19' connected to walls 4 and 6 by hinge portions 20' and depending downwardly to the ledge 2 which is integrally formed therewith and projects normal thereto. The support leg 21' extends downwardly into abutting engagement with the bottom wall and is connected to form a continuous cross member 23. The innermost support member 23 includes the pair of laterally spaced interlock slits 25 extending inwardly from the attachment slot 22 to slightly more than half of the depth of element 23. The slits 25 provide openings for interlocking with the corresponding slits 24 in support legs 21 of the adjacent front and back walls 3 and 5, as previously described.

In addition, in the illustrated embodiment of the invention, the connecting leg 19 formed in the sidewalls 3–6 each include interlock edge slits or openings 26 and projections or tab 27 which mate and interlock in the folded and assembled state. The edges of the adjacent ledge portions are similarly provided with edge projections or tabs 28 and recesses 29 to further interlock the members.

Thus, each ledge 2 is formed by overlapping shelf members or portions in the assembled relation of adjacent flaps of the flaps 15–18. The overlapping of the legs and ledges, and the tab and slot interact to secure the ledges 2 in abutting engagement to the sidewalls 3–6 and in a stable, appropriate spaced relationship.

The total rack structure can be formed from a single blank of foldable board material, as shown in FIG. 5. The front and back walls 3 and 5 are essentially identically constructed, as are the side-walls 4 and 6. The bottom wall members 10 and 12 are integrally secured to the front and back walls 3 and 5 with crease fold lines 30 at the point of connection. The members 10 and 12 are shown as generally rectangular members, having a depth slightly greater than half the depth of the housing 1 such that the folded members partially overlap. The overlapped portions include interlocking projections and slots. Thus, the one flap member 12 is shown with a pair of recesses defining a centrally located projection 31. The bottom member 10 on the front wall member 3 of the illustrated embodiment has a single recess 32 of width generally slightly greater than the projection 31 formed in the opposite member 12. The outer and side edges of the bottom wall 10 are removed on an inclined line to define a pair of edge projections 33 adjacent the projections 31 of a width slightly less than that of the recesses on the opposed member. In the overlapped relationship, the projections 31 and 33 and the recesses 32 are interlocked to support and stabilize the bottom wall.

The bottom wall members 11 and 13 are similarly connected to the sidewalls 4 and 6 by hinge portions 34 and are similarly formed. Each member 11 and 13 is a generally L-shaped member having an outer projecting leg portion and an inclined lateral leg portions. The members are folded inwardly beneath the interlock bottom wall members 10 and 12.

The blank of FIG. 5 is thus readily wrapped at each fold or hinge point 30 and 34 in the housing 1. The sidewalls 3–6 are provided with four creased portions 35 to define hinge connections which facilitate wrapping of the blank into the rectangular housing 1. A slight extension or edge flap 36 is provided on the one end sidewall, shown as wall 4, to overlap the illustrated front sidewall 3. The flap 36 is provided with a suitable self-adhesive, or a separate adhesive is applied, as at 37 and secures the flap to the abutting sidewall 5. The adhesive connection is a convenient and inexpensive attachment means. Any other means, such as a mechanical attachment with rivets, pins, tape, interlocking tabs and slots or the like, can be used.

Each of the ledge member 16–18 is secured to the upper edge of the front, back and sidewalls and is also similarly formed with the folding crease 20 to define a hinge connection to the corresponding sidewalls. Similar creases 39 and 40 are provided to the opposite ends of the ledge 2 to define hinge connections for convenient folding of the legs relative to the ledge for location of the ledge in the desired general horizontal orientation.

It will be readily recognized that the total member can be formed from a single board or sheet of an appropriate width and length and of a foldable material. Further, a web of appropriate material can be fed continuously or in a stepped manner through an appropriate die cutting and creasing apparatus to form successive blank members, each of which can then be appropriately folded into a flat assembly for convenient storage, shipment and generally handling.

Further, although shown in a particular configuration, other shapes and configurations can be employed. Thus, the bundling slots may be of some other configuration such as a relatively narrow upper portion with a relatively large lower portion to permit the convenient passage of the line beneath the stacked papers. In addition, the respective elements may be otherwise also shaped and formed.

The bottom wall members are shown with a known box construction and maybe modified to any desired construction. Although not considered desirable, the bottom members may even be eliminated.

The shelf or ledge forming members 4 may, for example, be formed with a continuous slot to define separate spaced support legs.

On set of depending support legs may include side edges provided with locking tabs 50 which assembled with slits 51 in the adjacent support legs.

Although the embodiment of a single piece construction is particularly preferred, the rack can be formed with the outer housing and with a separate ledge unit formed from a single integral board member within the broadest aspect of the invention.

The final structure in accordance with the invention includes the foldable wall structures with the multiple overlapping portions forming the support ledges and the legs interlocked to each other and to the housing sidewalls, and preferably with the stabilized bottom wall, to provide a stable self-supporting structure which will provide an effective and long life, depending upon the care with which the product is handled. Again, the rack can be formed from a blank of suitable material such as cardboard, paperboard and other materials as previously discussed thereby providing a relatively inexpensive box structure.

Various modes of carrying out the invention are contemplated as being within the scope of the following claims particularly pointing out and distinctly claiming the subject matter which is regarded as the invention.

I claim:

1. A paper support bundling apparatus comprising an essentially continuous sidewall having four sidewalls and further formed of a flat board-like material having four corners and interconnected in at least three corners by interconnections, a separate interconnecting unit connected at said fourth corner to form an integrated tubular rectangular structure, at least two of said sidewalls located on opposite sides of said rectangular structure including a substantially vertically extended opening extending downwardly from the top of said rectangular structure, four corner shelf members each including an interconnecting supporting vertical leg portion and a laterally and horizontally extended shelf portion interconnected to each other by a folded connection, said shelf portions being located above the bottom of said sidewall openings and said shelf portions located adjacent said sidewalls including said openings terminating adjacent the edges of said sidewall openings and forming a free unobstructed opening beneath the plane of said shelf portions including said supporting vertical leg portions interconnected to each other by mechanical fastener means extending beneath said unobstructed opening said shelf portion being located within said sidewall with said supporting leg portion of said shelf member folded into supporting and abutting engagement with said sidewall.

2. A low cost paper storage and bundling apparatus comprising an outer box-like rectangular housing having four sidewalls and an inner configuration substantially corresponding to the outer configuration of the papers to be stored, said box-like rectangular housing having vertical openings extending downwardly from the uppermost edge of each sidewall, a ledge unit located in said housing and defining a plurality of spaced ledges located one in each corner of the housing, said housing and ledge unit formed of a single foldable panel including a ledge member secured to the upper end of each sidewall, each ledge member including a ledge portion having integral depending leg portions secured to the opposite ends of the ledge portion and interconnected by an integral hinge portion, said ledge portion projecting perpendicular to a common edge of each of said leg portions and permitting folding of said ledge members, said ledge portions being foldable into a horizontal and overlapping relation within the corners of said housing between said vertical openings to form said ledges, whereby said ledge portions are located intermediate the depth of said vertical openings in said sidewalls for receiving a bundle of papers on said ledge portions with pass through openings located beneath the bundle of papers for interconnecting of the bundle.

3. The newspaper storage and bundling apparatus of claim 2 wherein said single foldable panel is manually foldable and comprising four sidewall sections forming said sidewalls and said ledge members, each of said ledge members being a substantially rectangular member, each of said sidewall sections having a bottom wall member projecting integrally from one end of each sidewall, said bottom wall members being connected with an integral hinge connection permitting folding of the bottom wall member inwardly beneath the housing, said bottom wall members being constructed and arranged with interconnecting mechanical coupling components for assembly of a bottom wall, each of said sidewalls having said ledge member projecting outwardly from the end edge opposite said bottom wall, said ledge members being connected by integral hinge connections to said sidewalls and including three portions including said depending connecting leg portion, said ledge portion and a final depending support leg portion horizontal and intermediate, said three portions being interconnected by integral hinge connects permitting folding of the ledge portion with respect to both said leg portions.

4. The apparatus of claim 3 wherein each depending leg portion having a length essentially corresponding to the length between the uppermost edge of the sidewall and the ledge portion and wherein the support leg portion having a length essentially corresponding to the depth from the ledge portion to the bottom wall whereby folding of said ledge portion normal to said depending and support leg portions and pivoting of the ledge member into abutting engagement with the interior wall of the sidewall locates the support leg portion in supporting abutting engagement with said bottom wall, the ledge portion on two opposed sidewalls being slightly longer to permit the resting of the ledge portions of the adjacent ledge members in overlapping relation, and interlocking elements between said ledge members and said sidewall members to firmly interconnect said ledge members within said housing to receive said bundle of papers resting on said ledge portions with access openings beneath said bundle of papers whereby the bundle of papers can be bundled and connected by a suitable encircling tie element.

5. A newspaper assembly and bundling apparatus comprising a single integral blank member formed of a manually foldable material and including four sidewall sections in side-by-side relation with outer edges adapted to be interconnected to form a rectangular housing, a ledge member projecting outwardly from the top edge of each sidewall and connected by a hinge portion, each ledge member including three sections including a first depending connecting leg section, an intermediate horizontal ledge section and a final depending support leg section, said three sections being interconnected by hinge portions permitting folding of the ledge member with respect to both said first and final leg sections for folding into said rectangular housing with said first depending leg sections abutting the sidewall and said ledge section projecting horizontally and said support leg section extending downwardly to the bottom of said sections to form a support for said ledge sections.

6. The apparatus of claim 5 wherein at least one of said sidewall section includes a bottom wall member connected thereto by a hinge portion for overlapped engagement with the bottom of said rectangular housing to form a bottom wall, and said support leg sections engaging said bottom wall.

7. The apparatus of claim 6 wherein said bottom wall member is formed from a plurality of separate bottom members connected one each to each of said sidewalls and adapted to be folded in partial overlapping relationship to each other, said separate bottom members being constructed with interconnecting mechanical coupling components for assembly of the bottom wall.

8. The apparatus of claim 5 wherein a ledge is formed by overlapped ledge sections on the adjacent sidewall section and with the connecting leg sections of one set of ledge members in opposite sides of the housing being slightly longer than the connecting leg sections of the adjacent leg members and the support leg sections being shorter than the support leg sections of the adjacent ledge members for stable superimposing of the ledge sections.

9. The apparatus of claim 8 including interlocking elements between said ledge members and said sidewall sections to firmly interconnect said ledge members and said sidewall sections.

10. The apparatus of claim 5 including interlocking elements between the ledge members and the sidewall sections to stabilize the apparatus.

11. The apparatus of claim 5 wherein said single integral blank member is a piece of material having fold lines, and said fold lines being formed to permit folding of the blank to form said sidewall sections and said ledge members.

12. The apparatus of claim 5 wherein said single integral blank member is a single integral piece of cardboard.

13. A paper storage and bundling apparatus formed from a single foldable planar element including a linear sidewall section including four sidewall panels located in immediate side-by-side relationship and interconnected by integral hinge portions permitting wrapping of said panels into a rectangular configuration by folding of said sidewall panels on said hinge portions to form a housing, bottom wall member integrally secured to the bottom edge of said sidewall panels with said bottom wall members integrally interconnected to an aligned sidewall panel by an integral hinge portion, said bottom wall members thus being adapted to be pivoted inwardly beneath said tubular housing and having mechanical interconnecting means for locking of bottom wall members to each other to form a bottom wall to said housing, four individual ledge members integrally connected to the top edge of each of the four said sidewall panels and projecting outwardly therefrom, a slot extended from within said sidewall panels outwardly through said ledge members, said slots beginning within said sidewalls adjacent the bottom in slightly spaced relation to the bottom edge of the sidewalls, each of said ledge members including a connecting leg panel adjacent said top edge of the sidewall panel and a shelf panel extending from the connecting leg panel and a support connecting leg panel extending from said shelf panel the shelf panel located intermediate the depth of the sidewall panels and said support leg panel being of a length to depend downwardly into supporting engagement with said bottom wall, the first and third ledge members located on the first and third sidewall panels and having the support leg panels and shelf panels of essentially identical size, the second and fourth ledge members having a connecting leg panel and shelf panel slightly shorter than said connecting leg panels and shelf panels of said first and third ledge members whereby said shelf panel of said second and fourth members is located immediately above and resting on the first and third ledge panels and the supporting leg panels of the first and third ledge members depending downwardly into abutting supporting engagement with the bottom wall, the supporting leg panels located in adjacent abutting relationship including interlocking mechanical slot and tabs for interconnecting of the supporting leg panels in position, and the outer side edges of each of said shelf panels including outwardly projecting tabs adapted to engage with slots in the sidewall panels to firmly interconnect and support said shelf panels.

* * * * *

UNITED STATES PATENT AND TRADEMARK OFFICE
CERTIFICATE OF CORRECTION

PATENT NO. : 5,005,709

DATED : April 9, 1991

INVENTOR(S) : RICK W. STOKES

It is certified that error appears in the above-identified patent and that said Letters Patent is hereby corrected as shown below:

On Title Page: [56] References Cited;
Please add:--Des. 230,802 3/1974 Morita
Des. 249,617 9/1978 Bozicnik
Article on paper packer by the "The Chef's Catalog" of Denver, Colorado
Article on "Old News™ Bindery" by Holst, Inc. of Tawas City, MI--

Claim 1, Col. 6, Line 50, after "support" insert --and--; Claim 3, Col. 7, Line 51, after "portion" insert "horizontal and intermediate"; Claim 3, Col. 7, Lines 52-53, after "portion" delete "horizontal and intermediate"; Claim 3, Col. 7, Line 54, delete "connects" and substitute therefor ---connections---; Claim 6, Col. 8, line 30, delete "section" and substitute therefor ---sections---; Claim 13, Col. 9, Line 5, delete "member" and substitute therefor ---members---; Claim 13, Col. 9, Line 17, delete "through" and substitute therefor ---into---.

Signed and Sealed this

Fifteenth Day of September, 1992

*Attest:*

DOUGLAS B. COMER

*Attesting Officer*

*Acting Commissioner of Patents and Trademarks*